US009394156B2

(12) United States Patent
Xia et al.

(10) Patent No.: US 9,394,156 B2
(45) Date of Patent: Jul. 19, 2016

(54) OIL FILLING NOZZLE WITH VAPOR RECOVERY FUNCTION

(71) Applicant: Tatsuno Corporation, Tokyo (JP)

(72) Inventors: Jianyoung Xia, Tokyo (JP); Kanan Sato, Tokyo (JP)

(73) Assignee: Tatsuno Corporation, Tokyo (JP)

( * ) Notice: Subject to any disclaimer, the term of this patent is extended or adjusted under 35 U.S.C. 154(b) by 419 days.

(21) Appl. No.: 13/746,107

(22) Filed: Jan. 21, 2013

(65) Prior Publication Data

US 2014/0076460 A1 Mar. 20, 2014

(30) Foreign Application Priority Data

Sep. 19, 2012 (JP) ..... 2012-205217

(51) Int. Cl.
*B67D 7/04* (2010.01)
*B67D 7/54* (2010.01)

(52) U.S. Cl.
CPC . *B67D 7/048* (2013.01); *B67D 7/54* (2013.01)

(58) Field of Classification Search
CPC ..... B67D 7/048; B67D 7/54
USPC ..... 141/59, 285
See application file for complete search history.

(56) References Cited

U.S. PATENT DOCUMENTS 3,899,009 A * 8/1975 Taylor ..... 141/59
4,056,131 A 11/1977 Healy
4,141,393 A * 2/1979 Mayer ..... 141/206
4,286,635 A 9/1981 McMath
4,497,350 A 2/1985 Guertin
5,273,087 A * 12/1993 Koch et al. ..... 141/94
5,832,970 A 11/1998 Carow
6,095,204 A * 8/2000 Healy ..... B67D 7/54 141/198
6,332,483 B1 * 12/2001 Healy ..... 141/59
6,418,981 B1 * 7/2002 Nitecki et al. ..... 141/4
8,371,341 B2 * 2/2013 Gray ..... B67D 7/048 141/59
8,739,842 B2 * 6/2014 Bolt et al. ..... 141/302
2004/0069366 A1 * 4/2004 Van Coillie et al. ..... 141/59

OTHER PUBLICATIONS

European Search Report in relation to European Patent Application No. EP 13151552.0-1712 dated Jan. 22, 2014; 7 pages.

* cited by examiner

*Primary Examiner* — Timothy L Maust

(74) *Attorney, Agent, or Firm* — Stetina Brunda Garred & Brucker

(57) ABSTRACT

To provide an oil filling nozzle with vapor recovery function capable of controlling opening degree of a vapor passage depending on flow rate and adjusting recovery rate. The oil filling nozzle includes a discharge pipe 3 mounted to a front end of a nozzle; a vapor control valve 21 arranged in a middle of a pipe, which connects a vapor collector 19 mounted so as to cover a circumference of the discharge pipe and a vapor passage 22, the vapor control valve 21 being opened and closed by liquid pressure in a nozzle main body 2; and a means for adjusting vapor recovery rate by adjusting opening degree of the vapor control valve 21.

5 Claims, 8 Drawing Sheets

OIL FILLING NOZZLE WITH VAPOR RECOVERY FUNCTION

CROSS-REFERENCE TO RELATED APPLICATIONS

The present application claims priority to Japanese Patent Application No. 2012-205217 filed Sep. 19, 2012.

STATEMENT RE: FEDERALLY SPONSORED RESEARCH/DEVELOPMENT

Not Applicable

BACKGROUND OF THE INVENTION

1. Technical Field of the Invention

The present invention relates to an oil filling nozzle having a means for recovering vapor generated in oil filling services.

2. Description of the Related Art

In case that highly-volatile fuel such as gasoline is fed to a fuel tank of an automobile, large quantities of vapor generate and are released into the atmosphere, which increases a risk of inflammability and causes an environmental pollution.

On the other hand, recovery rates of devices for recovering the vapor differ in each countries (100%±5% in Europe, 100%-120% in China), and adjustment of the recovery rate is performed by changing cross-sectional area of a vapor passage.

In addition, as described in the Patent Document 1, a diaphragm valve is connected to a vapor passage in order that the recovery rate becomes constant in a wide flow rate range, and the diaphragm valve is controlled to be opened and closed by liquid pressure in a nozzle main body.

However, the adjustment of the recovery rate is determined by elasticity of the diaphragm valve itself, so that the adjustment is effectual in certain flow rate, but the recovery rate varies with the flow rate when the recovery rate is changed from 120% (the line A in the FIG. 8) to 100% (the line B in the FIG. 8).

The content of Japanese Patent Application Publication No. 2004-142812 is incorporated herein by reference in its entirety.

BRIEF SUMMARY OF THE INVENTION

The present invention has been made in consideration of the above problems in the conventional art, and the object thereof is to provide an oil filling nozzle with vapor recovery function for controlling opening degree of a vapor passage depending on the flow rate, and enabling to adjust the vapor recovery rate.

To achieve the object, an oil filling nozzle with vapor recovery function according to the present invention includes: a discharge pipe mounted to a tip of a nozzle; a vapor control valve arranged in a middle of a pipe, which connects a vapor collector mounted so as to cover a circumference of the discharge pipe and a vapor passage, the vapor control valve being opened and closed by liquid pressure in a main body of the nozzle; and a means for adjusting vapor recovery rate by adjusting opening degree of the vapor control valve.

With the present invention, it is possible to recover the vapor by automatically adjusting the opening degree of the vapor control valve in proportion to the flow rate of fuel in oil filling services and to set maximum recovery rate of the vapor control valve by the means for adjusting the vapor recovery rate.

DETAILED DESCRIPTION OF THE INVENTION

Next, details of the present invention will be explained with reference to illustrated embodiments.

Figure 1:
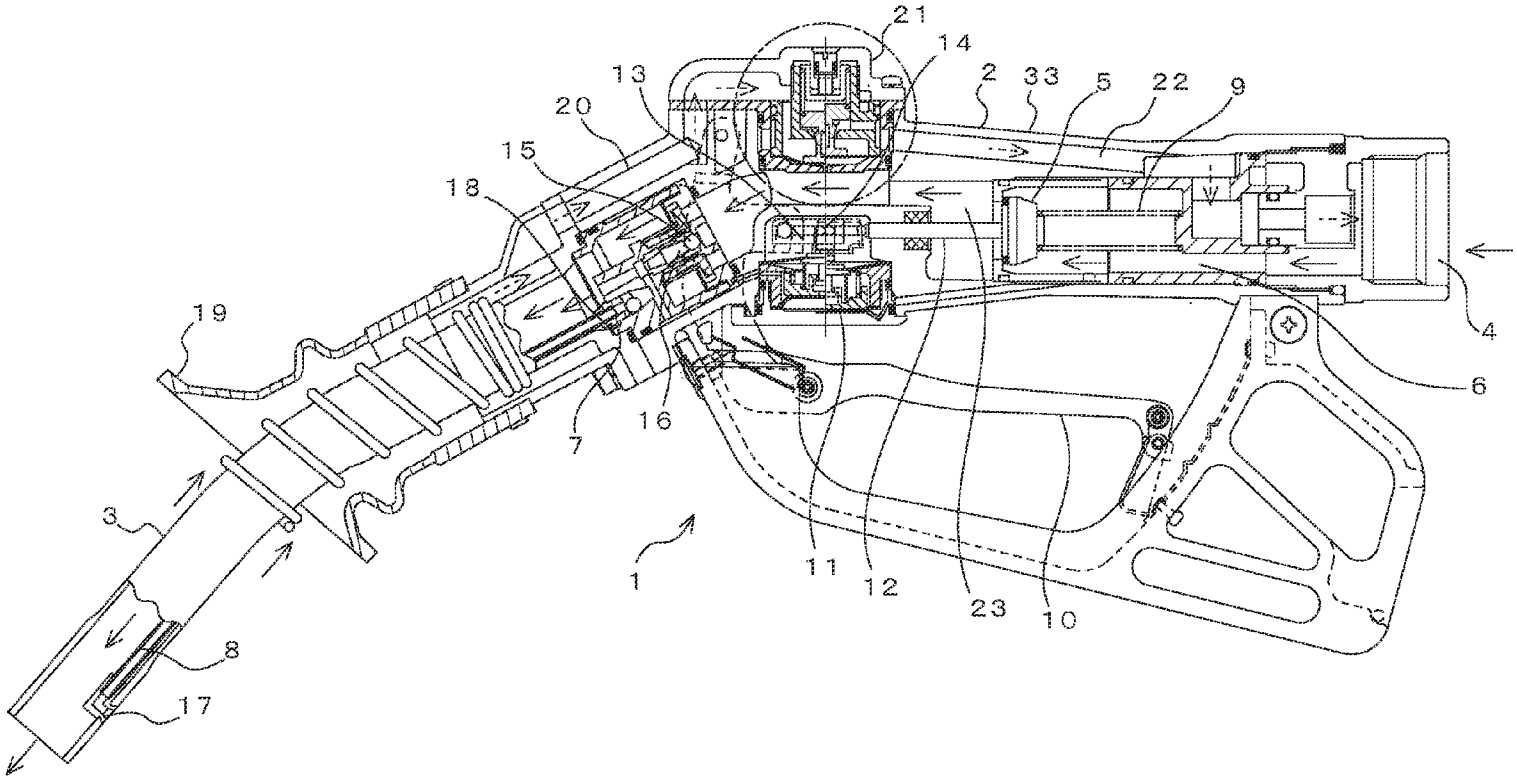
FIG. 1 is a cross-sectional view showing an oil filling nozzle with vapor recovery function according the first embodiment of to the present invention.

FIG. 1 shows an oil filling nozzle 1 according to the first embodiment of the present invention, and in this embodiment will be explained one with an automatic closing valve mechanism described in the Patent Document 2 as an example. In the figure, the solid arrows show a liquid flow, and the dashed arrows show a vapor flow.

A discharge pipe 3 is mounted to an end of a main body 2 of the oil filling nozzle 1, and to the rear end thereof is mounted a connecting port 4 to which an oil filling hose connected. In the main body 2 are disposed a main valve 5, an automatic valve closing mechanism 6 and a negative pressure generation part 7, and to the discharge pipe 3 is arranged a negative pressure pipe 8.

The main valve 5 is closed by a spring 9, and pulling a lever 10 allows the main valve 5 to open via the automatic valve closing mechanism 6.

To a diaphragm 11 of the automatic valve closing mechanism 6 is mounted a locking pin 14 for changing connection/disconnection between a valve stem 12 and a slide stem 13 of the main valve 5, and a tip of the slide stem 13 is in contact with the lever 10. A check valve 15 of the negative pressure generation part 7 is closed by a spring 16, and is opened by pressure of an oil flowing in the main body 2. One end of the negative pressure pipe 8 has an opening 17 near the tip of the discharge pipe 3, and the other end thereof has an opening 18 in the position of the check valve 15 of the negative pressure generation part 7, and a negative pressure generated in the negative pressure generation part 7 acts to the diaphragm 11 of the automatic valve closing mechanism 6 when the opening 17 is closed by bubbles in fuel oil.

A vapor collector 19 is made of rubber with an opening at the front end thereof, and is mounted to the main body 2 so as to cover the discharge pipe 3. The rear end of the vapor collector 19 is connected to an inlet opening of the vapor control valve 21, which characterizes the present invention, via a flow passage 20. An outlet opening of the vapor control valve 21 is in communication with a suction means not shown in the figure via a passage 22.

Figure 2:
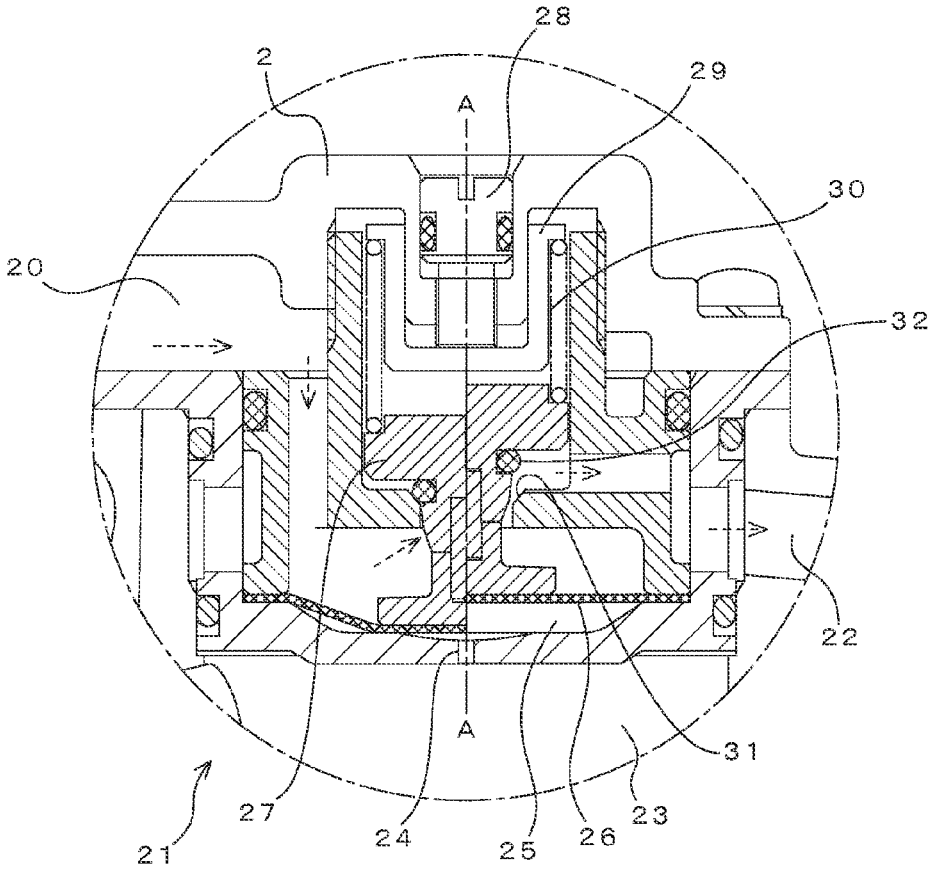
FIG. 2 is an enlarged cross-sectional view showing a vapor control valve.

The vapor control valve 21 is composed of, as shown in FIG. 2, a diaphragm 26 defining a valve chamber 25 that is in communication with a passage 23 downstream of the main valve 5 via an opening 24; a valve element 27 contacting the back face of the diaphragm 26; an adjustment screw 28 screwed into the main body 2; and a coil spring 30 having an upper end being in contact with a lower face of a holding plate 29 and a lower end being in contact with an upper end of the valve element 27.

The axes of the valve element 27, the adjustment screw 28, the holding plate 29, and the coil spring 30 coincide with each other, so that mounting area of the vapor control valve 21 can be decreased as small as possible.

The valve element 27 is configured as a conical body that enables coming in contact with and separating from a valve seat 31, which is formed so as to section the vapor passage 22, and to the valve element 27 is attached an O-ring 32 for closing the valve seat 31 when liquid pressure does not act.

Figure 3:
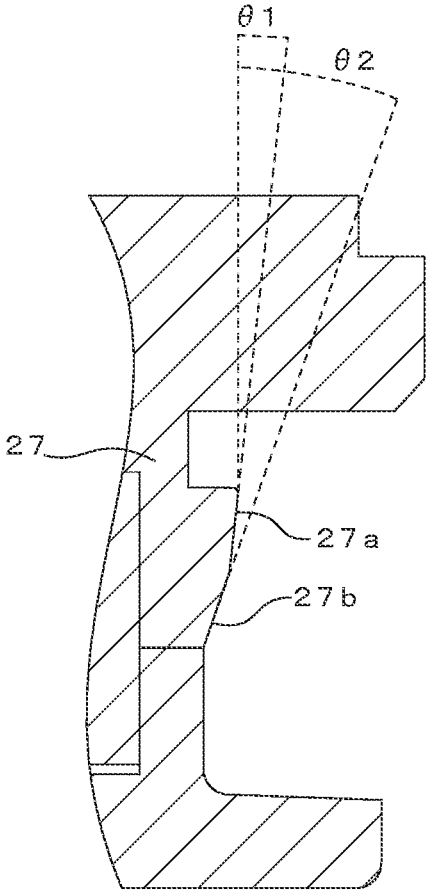
FIG. 3 is an enlarged view showing a valve element of the vapor control valve.

The valve element 27 is preferably provided with, as shown in FIG. 3, taper portions 27*a*, 27*b* in a longitudinal direction in multistage, and the taper angles θ1, θ2 thereof increase as approaching a lower end.

Figure 4:
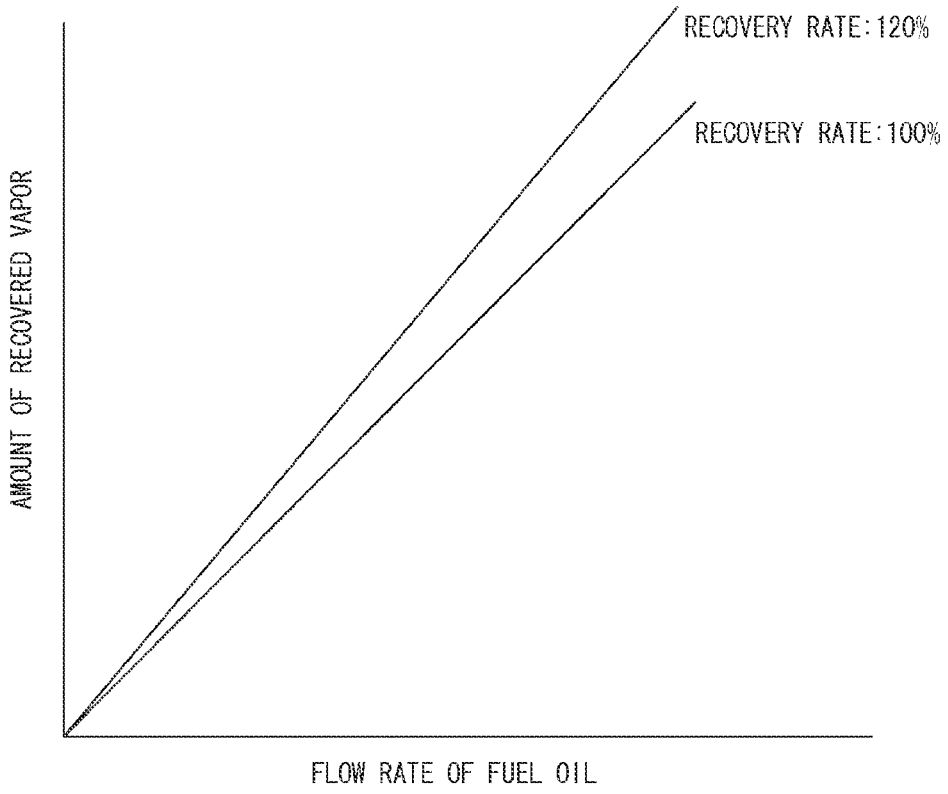
FIG. 4 is graphs showing changes of the amount of recovered vapor to flow rate of the nozzle with the above valve element.

Specifically, the taper angle θ2 of the lower taper portion 27*b* of the valve element 27 is larger than the taper angle θ1 of the upper taper portion 27*a* the valve element 27 (θ1<θ2), which can maintain changing ratio of the amount of recovered (sucked) vapor to the flow rate of the fuel oil with respect to each set recovery rate as shown in the FIG. 4.

More specifically, in order to increase the vapor recovery rate, a suppress strength of the coil spring 30 to the valve element 27 is decreased by the adjustment screw 28 to allow the valve element 27 to act in a larger taper angle (θ2) range, which increases the changing ratio of valve opening to flow rate of fuel oil.

Handling a grip portion 33 of the oil filling nozzle 1 configured as described above and pulling the lever 10 after inserting the discharge pipe 3 to a fuel tank of an automobile allows the slide stem 13 to be pressed by the lever 10, and the valve stem 12 that is integrated with the slide stem 13 though the locking pin 14 is pressed, which causes the main valve 5 to open against the spring 9. When the main valve 5 opens, oil pumped via the oil filling hose 4 flows into the nozzle main body 2, and the oil opens the check valve 15 against the spring 16, and is discharged from the discharge pipe 3 to the fuel tank.

When an oil filling service starts, the liquid pressure in the passage 23 acts on the diaphragm 26 of the vapor control valve 21, which opens the vapor passage 22 after lifting the valve element 27 to a position that the liquid pressure balances a resistance of the coil spring 30.

Needless to say, when flow velocity in the oil filling service is fast, in other words, in case that the flow rate of the fuel oil is large, the liquid pressure is also high, so that the diaphragm 26 shortens the coil spring 30 with larger force, and the opening degree of the vapor control valve 21 becomes wide, which maintains the vapor recovery rate to be constant regardless of the flow rate.

Figure 5:
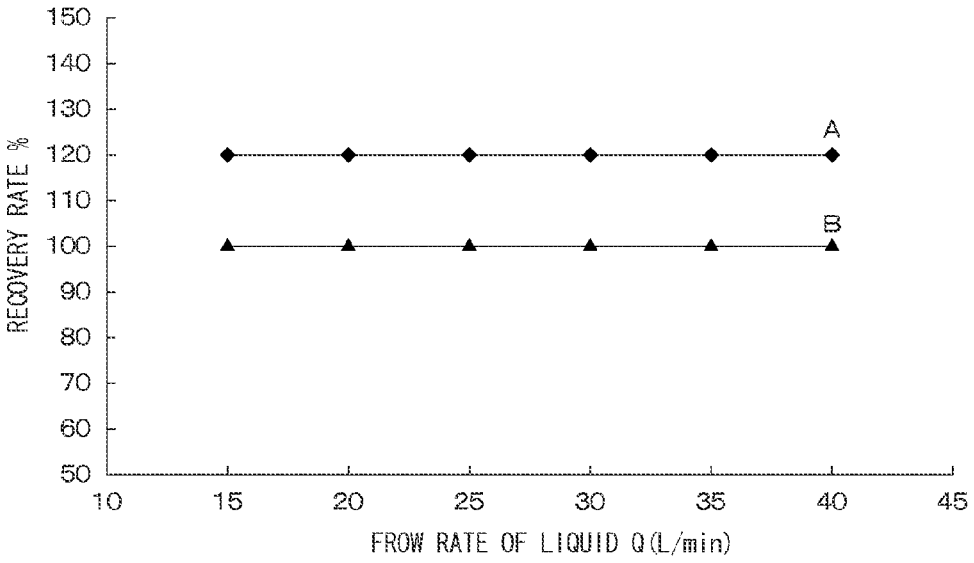
FIG. 5 is graphs showing changes of the amount of recovered vapor to the flow rate of the nozzle according to the present invention.

On the other hand, in case that the vapor recovery rate is changed from 120% (the line A in FIG. 5) to 100%, the adjustment screw 28 is rotated to change the resilient force of the coil spring 30 in such a manner that the resilient force is increased so as to decrease the moving range of the valve element 27 to the flow rate. With this, as shown in the line B of FIG. 5, flow rate of sucked vapor is decreased, and the vapor recovery rate can be maintained (100%) regardless of the flow rate.

Then, when the fuel tank becomes full, the opening 17 is closed by the oil surface, and a negative pressure generated at the opening 18 of the negative pressure generation part 7 is transmitted to the diaphragm 11 of the automatic valve closing mechanism 6, which causes the diaphragm 11 to curve to release the connection between the slide stem 13 and the valve stem 12 by the locking pin 14, and the main valve 5 is closed to finish the oil filling service.

Figure 6:
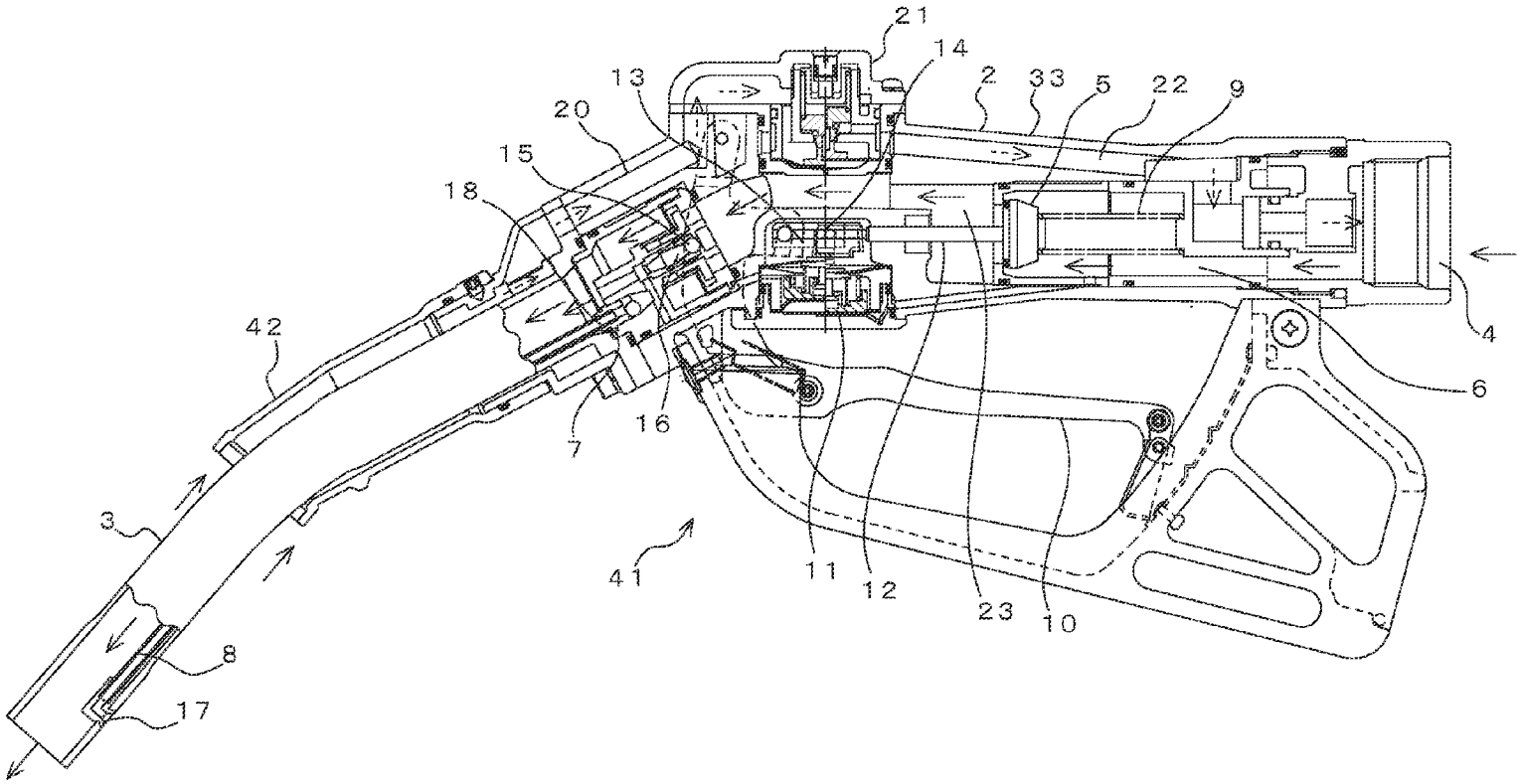
FIG. 6 is a cross-sectional view showing an oil filling nozzle with vapor recovery function according to the second embodiment of the present invention.

FIG. 6 shows an oil filling nozzle according to the second embodiment of the present invention, and the oil filling nozzle 41 includes a vapor collector 42 instead of the vapor collector 19 shown in FIG. 1. In FIG. 6, explanations on components the same as those of the oil filling nozzle 1 shown in FIG. 1 will be omitted with the same reference numbers as these of the nozzle 1 added.

The vapor collector 42 is made of metal, and is shaped smaller than the vapor collector 19 shown in FIG. 1. With this, the nozzle 41 can be shaped smaller and durability thereof can be improved.

Figure 7:
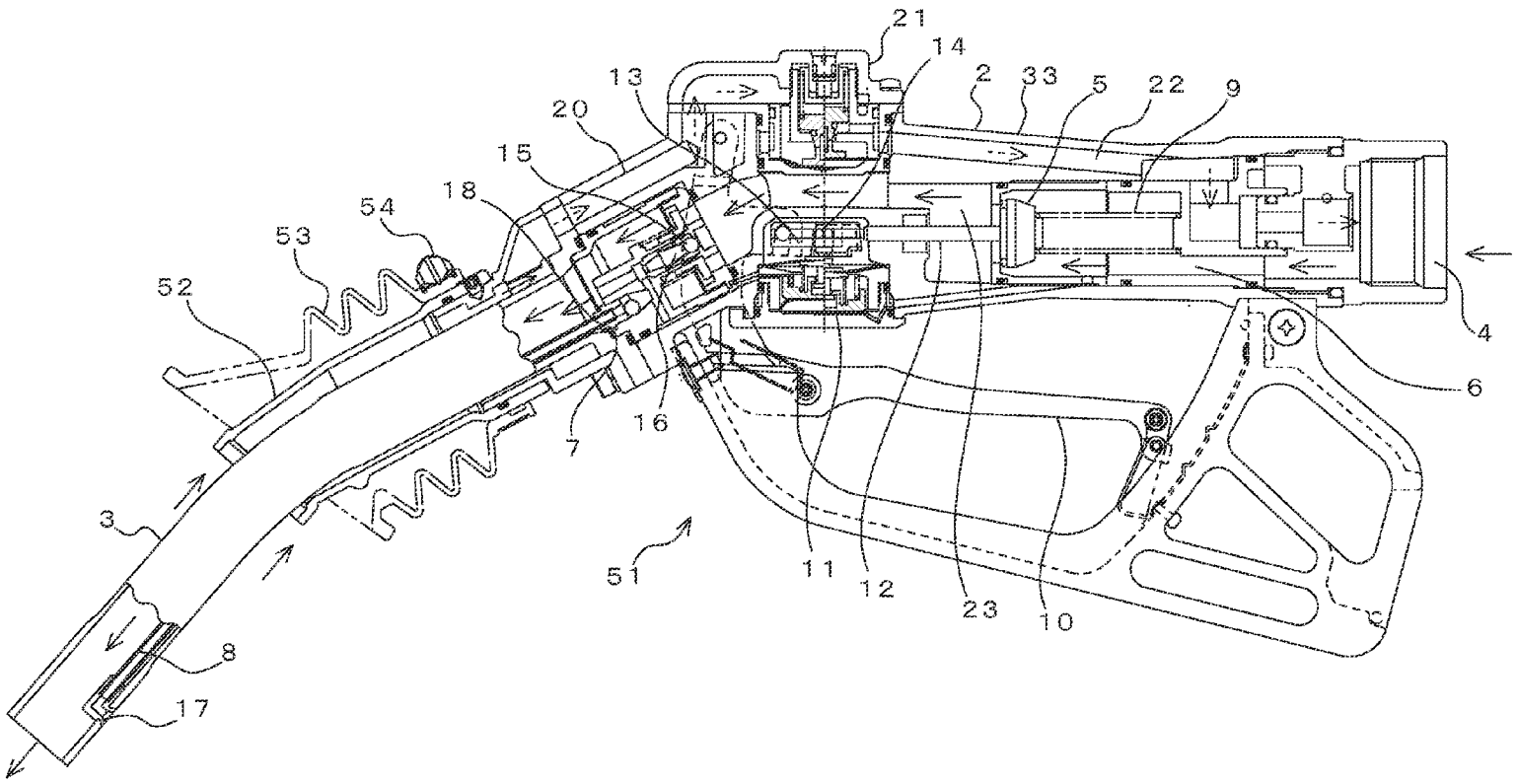
FIG. 7 is a cross-sectional view showing an oil filling nozzle with vapor recovery function according to the third embodiment of the present invention.
Figure 8:
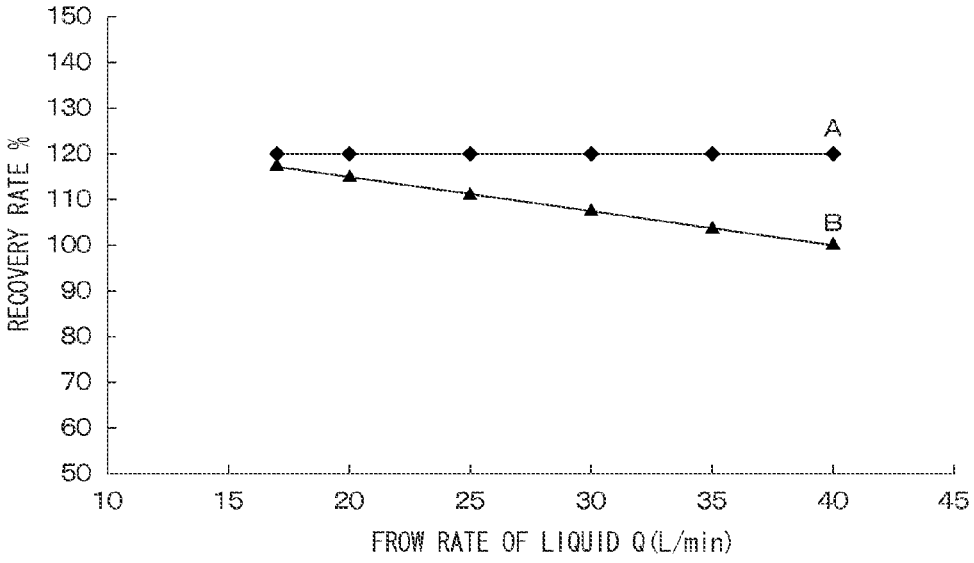
FIG. 8 is graphs showing changes of the amount of recovered vapor to flow rate of a conventional nozzle.

FIG. 7 shows an oil filling nozzle according to the third embodiment of the present invention, and the oil filling nozzle 51 includes a vapor collector 52 instead of the vapor collector 19 shown in FIG. 1, and further a rubber body 53 fixed to the main body 2 via a fastening member 54 so as to cover the vapor collector 52. In FIG. 7, explanations on components as same as those of the oil filling nozzle 1 shown in FIG. 1 will be omitted with the same reference numbers as these of the nozzle 1 added.

Like the above vapor collector 42, the vapor collector 52 is made of metal, and is shaped smaller than the vapor collector 19 shown in FIG. 1, and is durable.

Meanwhile, in oil filling services with the nozzle 1 shown in FIG. 1, the front end of the vapor collector 19 is not always attached firmly to a filling opening of a vehicle, in case that a space is left between the filling opening and the front end of the vapor collector 19, vapor is released via the space into atmosphere, and air may enter to the vapor passage to decrease the vapor recovery rate.

However, in the present embodiment, even when a space exists between the filling opening of a vehicle and the front end of the rubber body 53 vapor is not recovered by the rubber body 53, but remains therein, and is recovered by the vapor collector 52 located near the filling opening. With this, air in the atmosphere is hardly recovered, resulting in improved vapor recovery rate.

EXPLANATION OF REFERENCE NUMBERS

1 oil filling nozzle
2 main body
3 discharge pipe
4 connecting port
5 main valve
6 automatic valve closing mechanism
7 negative pressure generation part
8 negative pressure pipe
9 spring
10 lever
11 diaphragm
12 valve stem
13 slide stem
14 locking pin
15 check valve
16 spring

19 vapor collector
20 flow passage
21 vapor control valve
22 vapor passage
23 passage
25 valve chamber
26 diaphragm
27 valve element
28 adjustment screw
29 holding plate
30 coil spring
31 valve seat
32 O-ring
41 oil filling nozzle
42 vapor collector
51 oil filling nozzle
52 vapor collector
53 rubber body
54 fastening member

The invention claimed is:

1. An oil filling nozzle with a vapor recovery function comprising:

a discharge pipe;

a vapor control valve arranged in a middle of a pipe which connects a vapor collector mounted so as to cover a circumference of the discharge pipe and a vapor passage, said vapor control valve being opened and closed by liquid pressure in a main body of the nozzle, the vapor control valve including:

a valve seat; and a valve element moveable relative to the valve seat, the valve element being seated against the valve seat when the vapor control valve is closed and being spaced from the valve seat when the vapor control valve is open, the valve element including a first tapered surface associated with a first opening degree of the vapor control valve and a second tapered surface associated with a second opening degree of the vapor control valve; and an adjuster configured to adjust a vapor recovery rate by adjusting an opening degree of the vapor control valve.

2. The oil filling nozzle with vapor recovery function as claimed in claim 1, wherein said adjuster comprises:

a spring having one end in contact with the vapor control valve and another end in contact with a spring holder; and an adjustment screw for moving the spring holder in a direction to the one end or the other end of the spring.

3. The oil filling nozzle with vapor recovery function as claimed in claim 1, wherein a throttle portion of said vapor control valve is formed in multistage.

4. The oil filling nozzle with vapor recovery function as claimed in claim 1, wherein the adjuster is coupled to the vapor control valve such that movement of the adjuster results in movement of the vapor control valve.

5. The oil filling nozzle with vapor recovery function as claimed in claim 1, wherein the first tapered surface is angularly offset from the second tapered surface.

* * * * *